US006467808B1

(12) United States Patent
Kirby

(10) Patent No.: US 6,467,808 B1
(45) Date of Patent: Oct. 22, 2002

(54) BOOKSAVER

(76) Inventor: Cathie Kirby, 5118 Will Brown Rd., Spring Hill, TN (US) 37174

( * ) Notice: Subject to any disclaimer, the term of this patent is extended or adjusted under 35 U.S.C. 154(b) by 0 days.

(21) Appl. No.: 09/633,483

(22) Filed: Aug. 7, 2000

Related U.S. Application Data

(60) Provisional application No. 60/149,872, filed on Aug. 19, 1999.

(51) Int. Cl.[7] ..... B42D 9/00

(52) U.S. Cl. ..... 281/22; 116/239; 281/15.1; 281/20; 281/21; 281/28; 281/33; 281/42; 281/44; 281/45; 281/51

(58) Field of Search ..... 281/15.1, 20, 22, 281/28, 44, 51, 21, 33, 42, 45; 116/239

(56) References Cited

U.S. PATENT DOCUMENTS 763,554 A * 6/1904 Greene ..... 281/20
1,726,684 A * 9/1929 Sollom ..... 281/20
5,540,462 A * 7/1996 Laursdahl et al. ..... 281/20
5,634,666 A * 6/1997 Lee ..... 281/20
5,947,521 A * 9/1999 Stucki ..... 281/20
6,161,868 A * 12/2000 Verhoff et al. ..... 281/42

FOREIGN PATENT DOCUMENTS

DE 692472 * 6/1940 ..... 281/20

* cited by examiner

*Primary Examiner*—A. L. Wellington
*Assistant Examiner*—Mark T. Henderson
(74) *Attorney, Agent, or Firm*—Waddey & Patterson, P.C.; David B. Pieper

(57) ABSTRACT

A book support apparatus for supporting pages in a vertically positioned book. The book support apparatus includes a support body attached to a locating arm and optionally includes hinges and adhesive strips with peel off backings. A body addition may also be used with the support body to increase the thickness of the body for books needing increased support distances. The body addition may also include an adhesive strip with a peel off backing to allow for optional fixation to the body. A zigzag type of folding construction is also described.

14 Claims, 5 Drawing Sheets

BOOKSAVER

This application claims benefit of co-pending Provisional U.S. Patent Application Serial No. 60/149,872 filed Aug. 19, 1999, entitled "BOOKSAVER."

BACKGROUND OF THE INVENTION

The present invention relates generally to a storage protector for hardback books. More particularly, this invention pertains to a support for pages in stored books.

Books are one of the world's most valuable resources for education, reference, entertainment and pleasure. Nearly every household in modern civilization contains at least a few, some a great many, books. Hardback books are available in every size and have become increasingly more expensive and valuable. Therefore, it is becoming increasingly more important to protect books from damage to maintain their like-new quality and retain their value. This is especially true for book collections containing old or out of print books that are hard to duplicate.

Most hardback books are constructed with the cover extending approximately ⅛ to ¼ of an inch beyond the edge of the pages. The most common method of storing books when not in use is to stand the book on end on a shelf or between bookends. When books are positioned in this manner the bottom edges of the hard cover rest on the surface of the shelf and the pages. However, the bulk of the weight of the book, the pages, are suspended between the front and back cover and are dependent upon the strength of the binding to hold them in place. After time, sometimes a very short period of time, the binding weakens and pulls away from the spine at the top allowing the pages to droop and causing permanent damage to the book.

What is needed, then, is a spacer that will fit easily into the bottom end of any book to prevent this or any further damage of this nature from occurring.

SUMMARY OF THE INVENTION

This device is created as a spacer that will fit easily into the bottom end of any book to prevent page drooping damage of this nature from occurring.

The device consists of a firm, rectangular body with flexible arms affixed to each side of the body. The arms are placed inside the front and back covers of the book at the bottom end with the spacer lying flat against the bottom edge of the pages. When standing upright, on a shelf for instance, the pages rest on the spacer. This prevents the stress of the weight of the pages from separating the binding from the spine of the book.

The dimensions of the body of the device will be variable. Standard widths will range from ½ inch to 2 inches in increments of ½ inch. The depth of the body of the device will be manufactured in different depths, with standard depth being ⅛ and ¼ inch with optional, adhesive-backed additions of 1/16 inch depth that can be used as needed to make the device adjustable to any book. The length of the body of the device will be approximately 2 inches.

The arms are constructed of thin, posterboard-like material and are affixed to the body of the device with a flexible material that will allow the arms to lie flat in a horizontal line with the body of the device (this position allows the device to be used as a bookmark) or to be folded at a 90° angle perpendicular to the body of the device for placement in the book for storage on a shelf.

The dimensions of the arms of the device will be approximately 2 inches in width (the length of the body) and 4 inches long. The outside surface of one tab will be manufactured with a peel-off backing on an adhesive strip that will allow for the option of semi-permanent fixation to the inside back cover of the book.

When in use in a book stored in the upright position the device is essentially invisible inside the covers and underneath the pages in its supporting position. When the book is in use or being read, the device can be folded to a flat position for use as a bookmark or temporary storage inside the back cover of the book.

BRIEF DESCRIPTION OF THE DRAWINGS

A more complete understanding of the invention can be had by referring to the following Detailed Description taken with the accompanying drawings, wherein.

DESCRIPTION OF THE PREFERRED EMBODIMENTS

Figure 1:
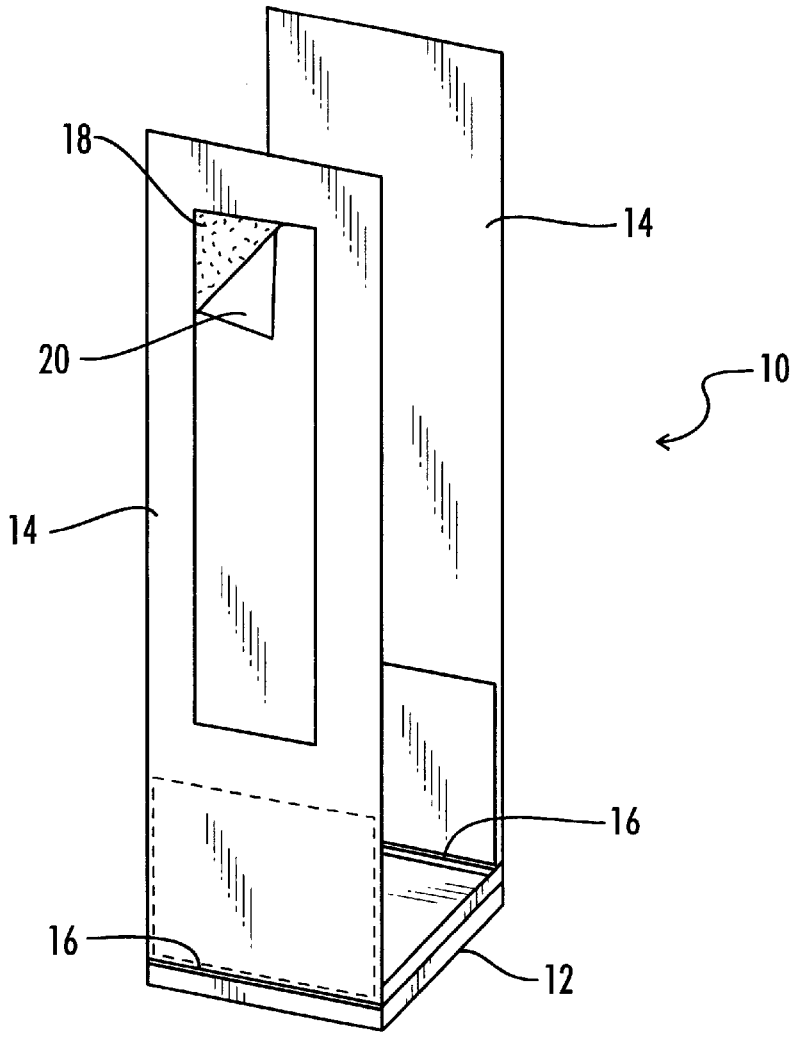
FIG. 1 shows a side view of a device forming a first embodiment of the present invention.

Referring now to the drawings, wherein like reference numerals designate like or corresponding parts throughout the several views, there is illustrated in FIGS. 1–11 a book support device, apparatus, or machine 10 forming a preferred embodiment of the present invention. The book support device 10 includes a support body 12 attached to locating arms 14 on either side of the body 12 with hinges 16. The book support device may also include an adhesive strip 18 with a peel off backing 20 on one of the locating arms 14 for attachment to a cover 30, 32 of a book 26. A body addition 22 may also be used with the body 12 to increase the thickness of the body 12 for books 26 needing increased support distances. The body addition 22 may also include an adhesive strip 18 with a peel off backing 20 to allow for optional fixation to the body 12.

The body 12, also known as a horizontal support 12 or page support 12, may be constructed of any material with sufficient firmness to provide for support of the pages 27 in the book 26. The preferred embodiment utilizes a pressed paper material or folded paper construction. It is envisioned that a single strip of paper could be folded in a zigzag style to form the body 12 configuration to provide this support with the paper acting as the hinges 16 and the ends sticking out for the arms 14. For the preferred embodiment, the body 12 will be manufactured from pressed paper in depths of ⅛ and ¼ inch making the depth variable. The body 12 will be manufactured in widths varying from ½ inch to 2 inches in increments of ½ inch. The zigzag construction may be manufactured with folding points to allow for variations when folding the device 10.

The locating arms 14, also known as a body locator 14 or support locator 14, can be rigidly fixed to the body 12, or joined to the body 12 with hinges 16. While the preferred embodiment uses two arms 14 attached to the sides of the body 12 with two hinges 16, the unit may also be constructed with one arm 14 connected to the center of the body 12 to be placed between the pages 27 of the book 26. For the preferred embodiment, the arms 14 are constructed of thin, posterboard-like material. The arms should be thin so that they can fit between the covers and the pages of the book or between the pages of the book, and should provide sufficient strength to hold the body 12 in position to support the pages. The arms 14 are designed with an adhesive strip 18 with a peel off backing 20 on one tab 14 to allow for semi-permanent or permanent fixation inside the front cover 30 or back cover 32 of the book 26. If a single arm 14 is used with the body 12 then the arm 14 could be placed in the middle of the body 12 to make the device 10 look like an upside down capitol letter "T". This embodiment is not shown in the drawings.

Figure 6:
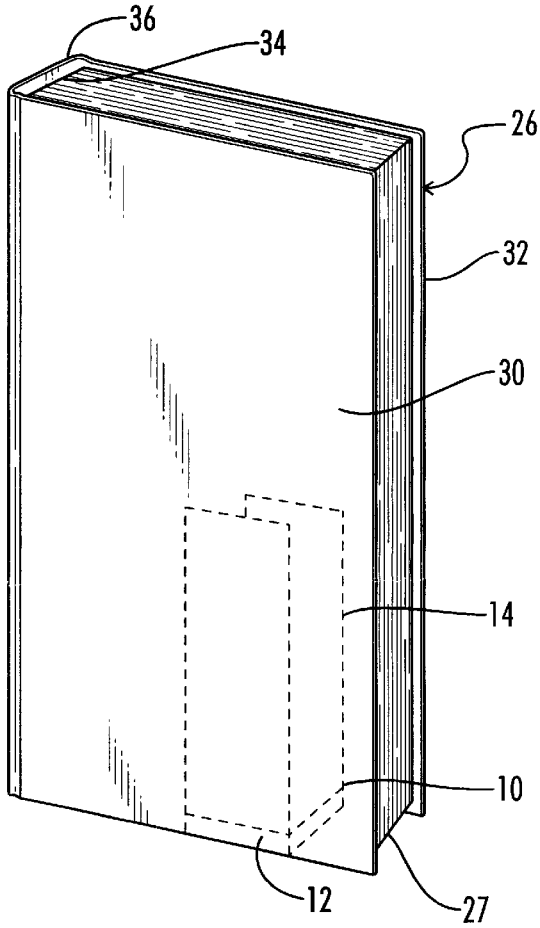
FIG. 6 illustrates the use of the device in a book to prevent damage to the binding and spine of the book.
Figure 7:
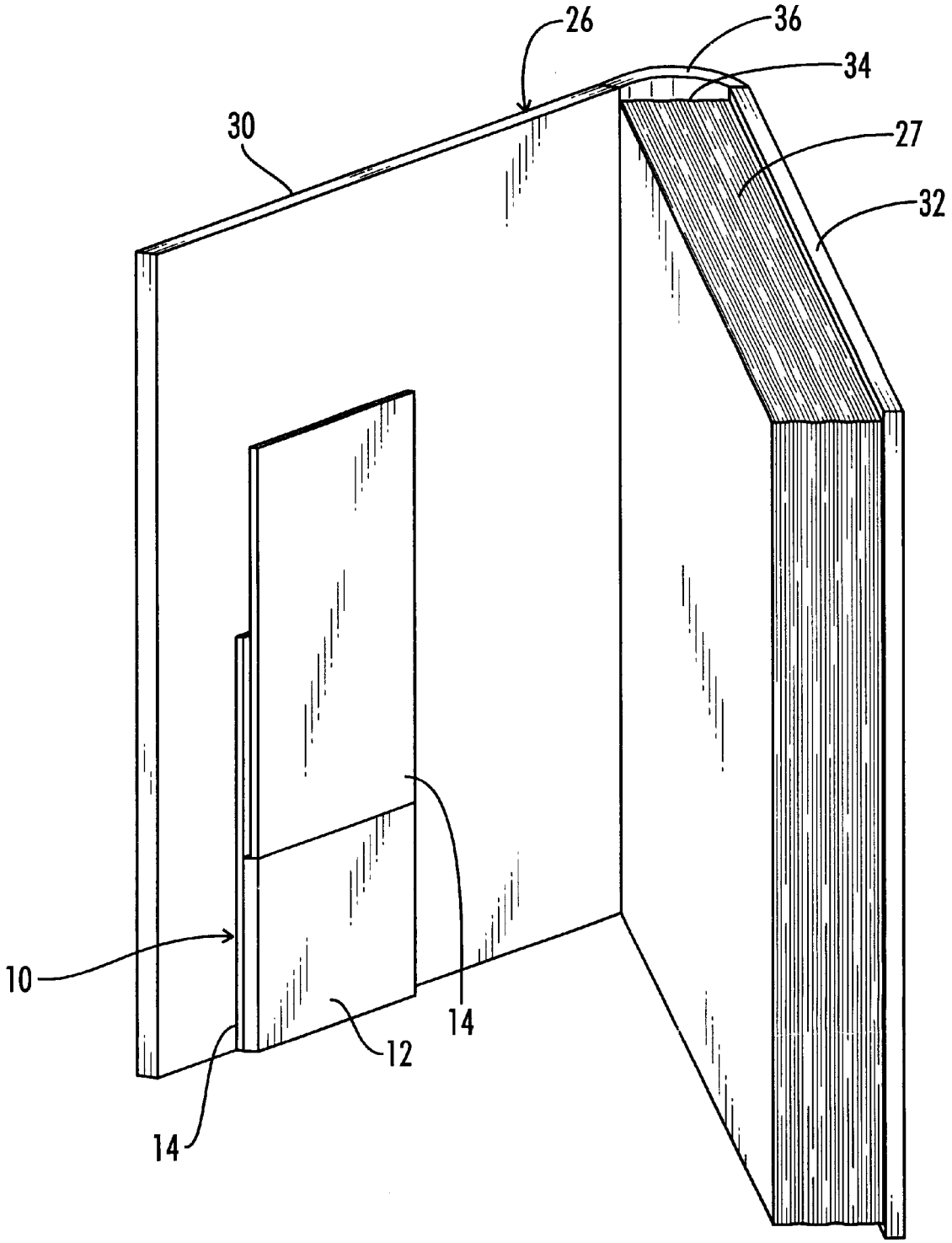
FIG. 7 illustrates the storage of the device in a book during use of the book.

The arms 14 and the body 12 are either directly connected in a rigid embodiment or connected with flexible hinges 16 to make the arms 14 moveable. The preferred embodiment uses two hinges 16 made from adhesive-backed cellophane to attach two arms 14 to the body 12. These hinges 16 allow the arms 14 to be folded to a 90° angle perpendicular to the body 12 for placement in the book 26, and also to be folded flat so that the device 10 may be stored in the front cover of the book when the book is being used. The use of the device 10 for support is shown in FIG. 6 and the storage of the device 10 mounted on the front cover 30 is shown in FIG. 7.

The adhesive strip 18 with a peel off backing 20 allows for the device 10 to be attached to one of the covers 30, 32 of the book 26. The adhesive is preferably of a stick and release type that will allow for connection and removal of the device 10 to the cover 30, 32 without destroying or harming the book 26 upon removal. Stick and release type glues are well known in the art of glues and a good example is used on the commonly used Post-it™ style of notepads from 3M Corporation.

Figure 2:
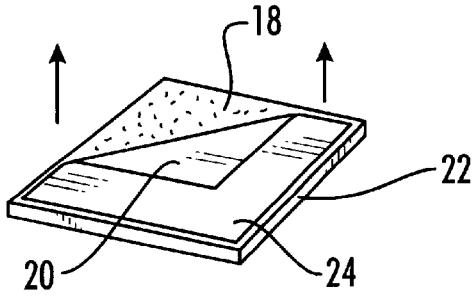
FIG. 2 shows an accompanying optional addition.

FIG. 2 illustrates the body addition 22 including an adhesive strip 18 with a peel off backing 20 to allow for optional fixation to the body 12. The preferred embodiment of the body addition 22 is formed from pressed paper measuring 1/16 inch in depth and having the length and width of the body 12 of the device 10 that it is manufactured to accompany. The body addition 22 is designed with an adhesive coating strip 18 on the connection side 24 with a peel off backing 20 to allow for optional fixation to the body 12 of the device 10. This makes the depth of the body 12 adjustable to almost any book 26.

Figure 3:
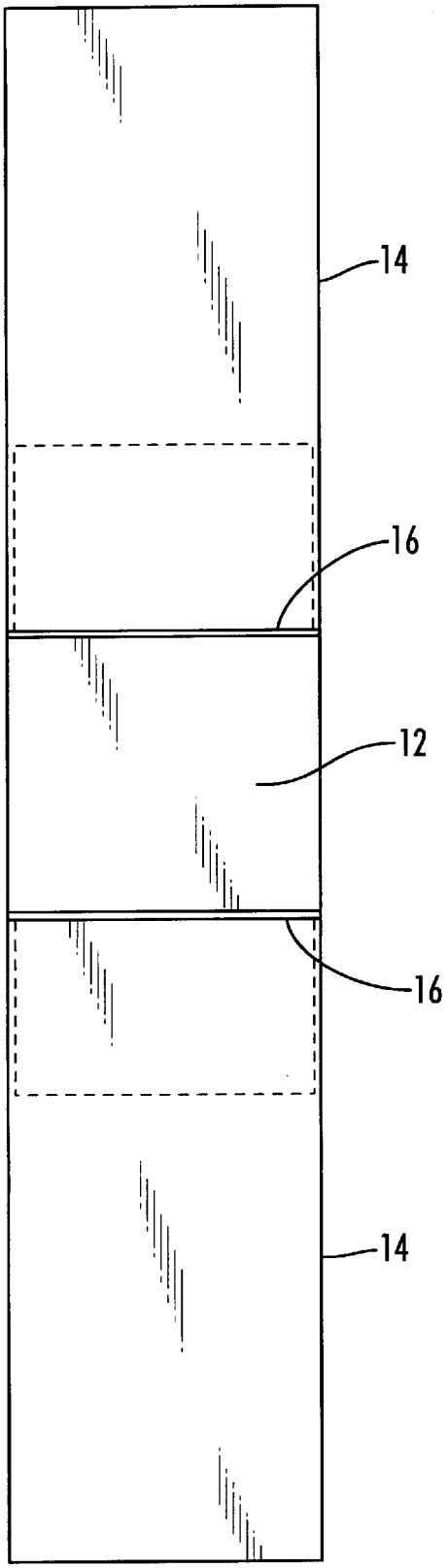
FIG. 3 illustrates a horizontal front view of the device.

FIG. 3 illustrates a top view of the device 10 unfolded to a flat position showing the arms 14 affixed to the body 12 by adhesive backed cellophane hinges 16.

Figure 4:
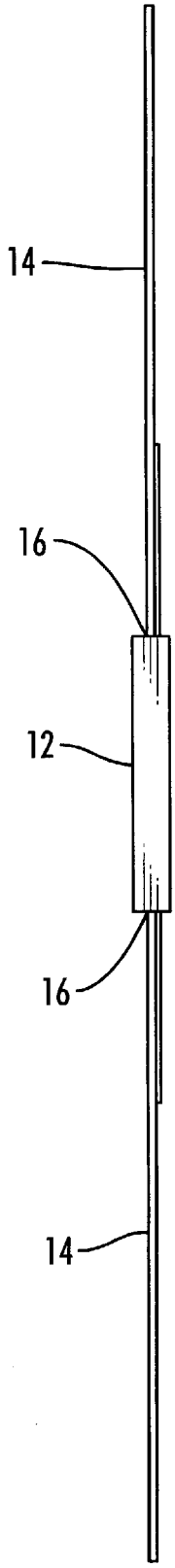
FIG. 4 illustrates a horizontal side view of the device.

FIG. 4 is a side, horizontal plane view of the device 10 unfolded to a flat position. In this position the device 10 can be used as a bookmark or stored inside the back cover 32 of the book 26 when the book 26 is in use.

Figure 5:
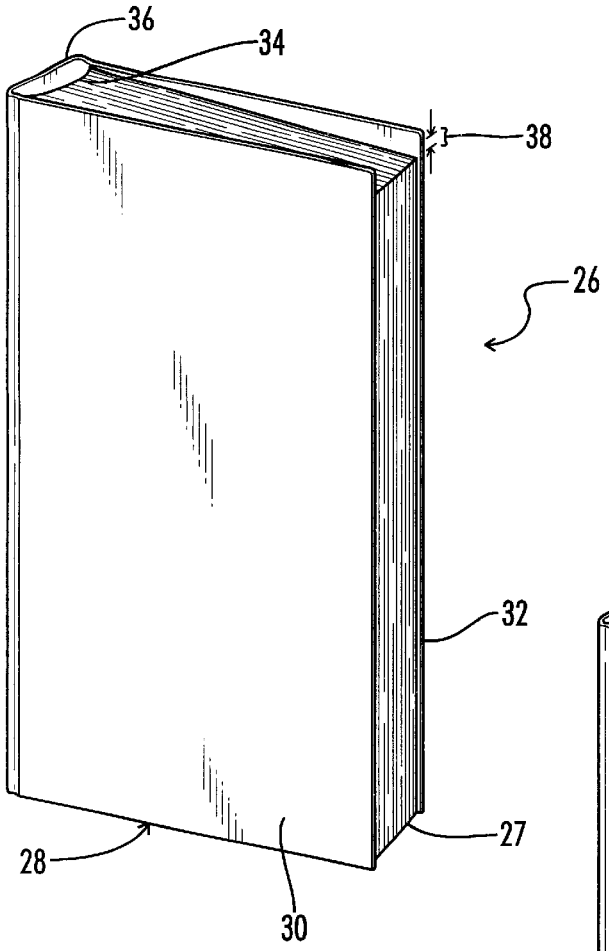
FIG. 5 (PRIOR ART)
FIG. 5 illustrates a prior art book stored in an upright position with page droop.

FIG. 5 illustrates a book 26 standing in a vertical position as is the generally adopted method for storing books 26 when not in use. The bottom edge 28 of the front cover 30 and back cover 32 rests on the storage surface. The weight of the pages 27, after a time, pulls the binding 34 away from the spine 36 at the top of the book 26. The pages 27 create a droop 38 and fall to rest on the storage surface between the front cover 30 and back cover 32.

FIG. 6 also illustrates a book 26 standing in a vertical position. The device 10 is illustrated in place with the arms 14 closed within the front cover 30 and the back cover 32 of the book 26 and the body 12 of the device 10 positioned under the bottom edge of the pages 27. The weight of the pages 27 rests on the body 12 of the device 10 preventing separation of the binding 34 from the spine 36 at the top of the book 26.

The pages 27 are not permitted to droop from the top edge but instead rest on the firm body 12 of the device 10 thereby elevated above the storage surface.

FIG. 7 illustrates the storage of the device 10 in a book 26 during use of the book 26. As illustrated in FIG. 7, the device 10 may be folded into a relatively flat position for storage while the book is being used. If a zigzag folded support were used, an even thinner profile could be obtained. However, the zigzag embodiment requires folding and unfolding the device 10, so the preferred embodiment utilizes the body 12 and arm 14 designs that are shown in FIGS. 1–7 for convenience of use.

Figure 8:
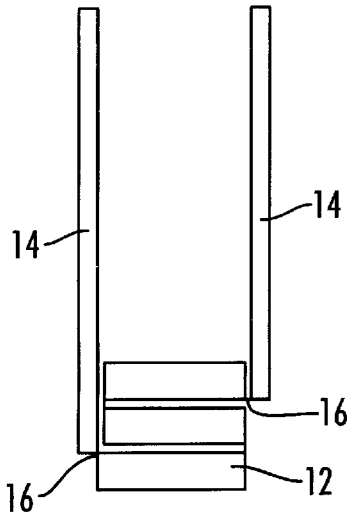
FIG. 8 illustrates a zigzag embodiment of the device configured for support.
Figure 9:
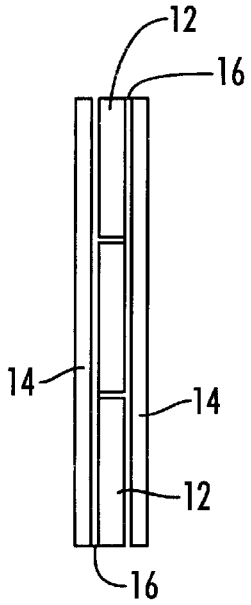
FIG. 9 illustrates a zigzag embodiment of the device folded for storage.
Figure 10:
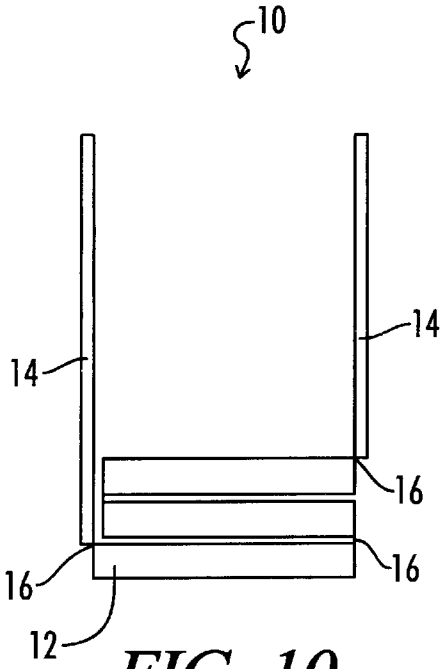
FIG. 10 illustrates an alternate zigzag embodiment of the device configured for supprt.
Figure 11:
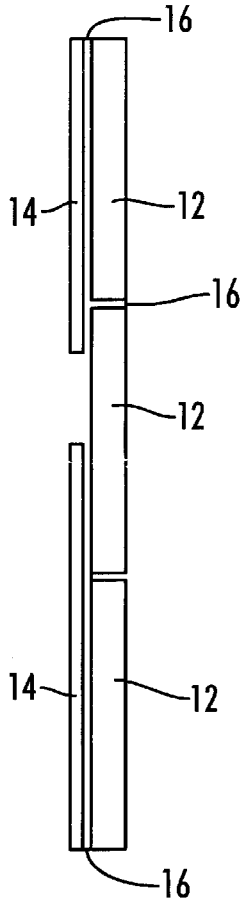
FIG. 11 illustrates an alternate zigzag embodiment of the device folded for storage.

Examples of the folded paper or zigzag configuration of the device 10 are shown in FIGS. 8, 9, 10, and 11. FIGS. 8 and 10 show how the zigzag embodiment of the device 10 is folded to be used for support, and FIGS. 9 and 11 show how the zigzag embodiments of the device 10 may be folded for storage. These embodiments use a single continuous sheet of paper to form the arms 14, body 12, and hinges 16 of the device 10. These are only illustrative examples of the multiple possibilities for the is folding designs of this invention and are not meant to limit the scope of the invention.

Depending on preference the device can be made of various materials including paper or plastic and secured together with a variety of materials. The only real requirement for the material is that it should last as long as the book, be capable of withstanding a book storage environment, and should be of an inert material that does not harm the book.

While only a few embodiments of the invention has been illustrated in the accompanying drawings, and described in the foregoing Detailed Description, it will be understood that the invention is not limited to the embodiments disclosed, but is capable of numerous rearrangements, modifications and substitutions of parts and elements without departing from the spirit of the invention.

Thus, although there have been described particular embodiments of the present invention of a new and useful Book Support, it is not intended that such references be construed as limitations upon the scope of this invention except as set forth in the following claims.

What is claimed is:

1. A book support apparatus for supporting an upright hardback book on a surface, the book including pages connected together at a binding, the binding attached to a cover at a spline, the cover including an outside and an inside, the inside of the cover facing the pages, the cover further including a lower cover edge and the pages including lower page edges, the lower cover edge extending past the lower page edges of the pages by a distance creating a gap between the lower page edges and the surface, the apparatus comprising:

a support body with a thickness attached to at least one locating arm, the locating arm adapted to be placed on the inside of the cover between the cover and the pages such that the attached support body is positioned in the gap between the surface and the pages of the book, whereby the thickness of the support body accounts for at least a portion of the distance between the edge of the pages and the cover so that the pages rest on the support body during storage to prevent separation of the binding from the spine caused by gravitational forces acting on the pages of the book; and a body addition attached to the support body by an adhesive strip.

2. The apparatus of claim 1, further comprising:

a hinge flexibly connecting the support body to the locating arm.

3. The apparatus of claim 1, further comprising:

an adhesive strip attached to the at least one locating arm.

4. The apparatus of claim 1, wherein the support body is constructed of a material with sufficient firmness to provide for support for the pages in the book.

5. The apparatus of claim 1, wherein the support body is constructed from a pressed paper material.

6. The apparatus of claim 1, wherein the support body is constructed with a folded paper construction.

7. The apparatus of claim 1, wherein a strip of paper is folded to form the support body and at least one locating arm.

8. The apparatus of claim 1, wherein the arms are constructed of thin, posterboard-like material.

9. The apparatus of claim 1, wherein the support body is constructed with a zigzag construction.

10. The apparatus of claim 2, wherein the hinges are made from cellophane.

11. The apparatus of claim 2, wherein the hinges are adapted to allow the arms to be folded to a first placement to support the book, and also to be folded to a second placement so that the device may be stored between the pages and the cover of the book.

12. The apparatus of claim 3, further comprising:

a peel off backing attached to the adhesive strip.

13. The apparatus of claim 5, wherein the adhesive is of a stick and release type.

14. The apparatus of claim 7 wherein the strip of paper includes folding points to allow for variations when folding the paper.

* * * * *